US012460395B2

(12) United States Patent
Jamilosa

(10) Patent No.: US 12,460,395 B2
(45) Date of Patent: Nov. 4, 2025

(54) LINER PLATE MOUNTING ASSEMBLY

(71) Applicant: Caterpillar Global Mining LLC, Tucson, AZ (US)

(72) Inventor: James G. Jamilosa, Waipahu, HI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 720 days.

(21) Appl. No.: 17/699,368

(22) Filed: Mar. 21, 2022

(65) Prior Publication Data

US 2023/0295904 A1 Sep. 21, 2023

(51) Int. Cl.

| | |
|---|---|
| ***E02F 9/28*** | (2006.01) |
| ***E02F 3/40*** | (2006.01) |
| *E02F 3/30* | (2006.01) |
| *E02F 3/32* | (2006.01) |

(52) U.S. Cl.

CPC ..... *E02F 9/2883* (2013.01); *E02F 3/40* (2013.01); *E02F 3/308* (2013.01); *E02F 3/32* (2013.01)

(58) Field of Classification Search

CPC ..... E02F 3/40; E02F 3/32; E02F 3/308; E02F 3/60; E02F 9/2883; E02F 9/2841

See application file for complete search history.

(56) References Cited

U.S. PATENT DOCUMENTS

| | | | | |
|---|---|---|---|---|
| 4,932,145 | A | 6/1990 | Reeves, Jr. | |
| 5,241,765 | A | 9/1993 | Jones et al. | |
| 8,561,326 | B2 * | 10/2013 | Ruvang | E02F 3/401 37/452 |
| 9,279,231 | B2 | 3/2016 | Bienfang et al. | |
| 9,840,830 | B2 | 12/2017 | Lammli | |
| 10,815,638 | B2 | 10/2020 | Voelz et al. | |
| 2013/0192101 | A1 * | 8/2013 | Gilmore | E02F 3/4075 37/445 |
| 2016/0046244 | A1 * | 2/2016 | Chewning | B60R 13/01 29/428 |

FOREIGN PATENT DOCUMENTS

| | | | |
|---|---|---|---|
| CN | 209011174 | U | 6/2019 |
| CN | 110158677 | A | 8/2019 |
| JP | 09088111 | A | 3/1997 |
| JP | 2001295315 | A | 10/2001 |
| JP | 2017014751 | A | 1/2017 |
| KR | 1020180016033 | A | 2/2018 |

OTHER PUBLICATIONS

Written Opinion and International Search Report for Int'l. Patent Appln. No. PCT/US2023/062244, mailed May 26, 2023 (9 pgs).

* cited by examiner

*Primary Examiner* — Joseph M Rocca
*Assistant Examiner* — Robert E Pezzuto

(57) ABSTRACT

A liner assembly for protecting a sidewall of a work implement associated with a work machine. The liner assembly includes a wedge, a wedge-plate interface, a liner plate, and a weld. The wedge comprising a receiving channel configured to support the liner plate and a slot for filling the weld to secure the wedge to the sidewall. The liner plate includes an engaging channel complementary to the receiving channel to form the wedge-plate interface which supports the liner plates on the wedge. The weld is further provided along the perimeter and gaps of the liner plates to secure the liner plate to the sidewall of the work implement.

20 Claims, 8 Drawing Sheets

LINER PLATE MOUNTING ASSEMBLY

TECHNICAL FIELD

The present disclosure generally relates to a work machine, and more specifically relates to a liner plate mounting assembly associated with protecting a work implement of a work machine.

BACKGROUND

Ground engaging equipment such as buckets, dippers, electric rope shovel buckets, and dig tools, are commonly used on work machines such as backhoes, front-end loaders, electric rope shovels, and excavators, to excavate earth material from the ground. To protect and extend the useful life of the ground engaging equipment from the abrasive and impactful forces during normal operations of the work machine, liner plates are generally installed inside and outside the sidewalls of a ground engaging equipment.

Conventional liner plates contain open slots across various central points of a liner plate so that a welding material may be provided in each slot and the perimeter of the plates to secure to a sidewall. Conventional plates need to be cut smaller to reduce the weight of each plate so that the central slot welds and perimeter welds can support the weight of each plate and keep it attached to the sidewall. If the plates are too large and heavy there is a high risk the liner plate will fall off the ground engaging equipment prematurely, especially during operation of the work machine even though the plates may still be useful. This adds unnecessary delay and service time to replace or re-weld the conventional plate back onto the sidewall of the ground engaging equipment.

The conventional plates are generally cut into smaller pieces which increases both part count and installation time. The increased number of plates creates more gaps between the plates which reduces protection and the useful life of the plates because the slots and gaps in between the plates cause the weld to be more prone to wearing out during operation of the work machine resulting in premature fall-out. When liner plates fall off prematurely, there is unnecessary added service time to re-weld or replace the liner plate with still a useful life available.

For example, U.S. Pat. No. 9,840,830 to Lammli discloses a wear strip assembly for ground engaging equipment. The wear strip assembly comprises a wear strip and a wear strip support. The wear strip has an engagement profile and a wear surface. The wear strip support defines a receiving profile complementary to the engagement profile of the wear strip. The engagement profile of the wear strip removably engages the receiving profile of the wear strip support, with the wear strip support having one or more openings distributed along an inner edge of the wear strip support and below the receiving profile. The one or more openings have a thickness that permits the wear strip support to be welded to the ground engaging equipment. However, this design uses liners that are limited to the width of the wear strip support and intended for flat sections or surfaces. For curvature sections on an excavator bucket, more narrow wear strip supports would be required. The wear strip of Lammli does not allow for the strip to be formed to the shape of the sidewall and secured directly to the sidewall by a weld and also requires an increase in gaps between the strips. Moreover, the weld is primarily provided along the wear strip support and not the wear strip itself as the wear strip is above the edge where the wear strip support meets the ground engaging equipment. The wear strip does not extend over this edge, is not formed to the shape of the ground engaging equipment, is not directly secured to the ground engaging equipment, and comprises gaps between strips.

Other methods of attaching the liner plates on a ground engaging equipment or work implement include using fastening methods. A liner plate may be available with factory mounting studs for ease of installation, utilizing stud welded bolts or self-tapping screws. However, these liner plates are prone to prematurely fall-out.

It is desirable to have a mounting assembly to reduce part counts, decrease gaps between plates, shorten installation and service time, and reduce liner plates from prematurely falling out.

SUMMARY OF THE DISCLOSURE

In accordance with one aspect of the disclosure, a liner assembly for a work implement of a work machine is disclosed. The liner assembly comprises a sidewall of the work implement, a wedge, and a liner plate. The wedge includes a slot and a receiving channel, the wedge being mounted to the sidewall by filling the slot with a weld. The liner plate is supported by the wedge and includes an engaging channel complementary to the receiving channel to form a wedge-plate interface connecting the liner plate to the wedge and onto the sidewall.

In another embodiment, a work machine is disclosed comprising a frame, a ground engaging element supporting the frame for movement, an engine mounted on the frame, and a boom extending from the frame comprising a work implement. The work implement includes a sidewall and a liner assembly. The liner assembly including a wedge, and a liner plate. The wedge includes a slot and a receiving channel, the wedge being mounted to the sidewall by filling the slot with a weld. The liner plate is supported by the wedge and includes an engaging channel complementary to the receiving channel to form a wedge-plate interface connecting the liner plate to the wedge and onto the sidewall.

In another embodiment a method of protecting a sidewall of a work implement of a work machine using a liner assembly is disclosed. The method comprises of providing a wedge, a liner plate, and a weld material wherein the wedge includes a slot and a receiving channel, and the liner plate includes an engaging channel complementary to the receiving channel to form a wedge-plate interface for attaching the liner plate on the wedge; welding the wedge to the sidewall by filling the weld into the slot; and securing the liner plate on the wedge by inserting the engaging channel onto the receiving channel.

These along with other aspects and features of the present disclosure will be better understood upon reading the following detailed description when read in conjunction with the accompanying drawings.

The figures depict one embodiment of the presented invention for purposes of illustration only. One skilled in the art will readily recognize from the following discussion that alternative embodiments of the structures and methods illustrated herein may be employed without departing from the principles described herein.

DETAILED DESCRIPTION

Figure 1:
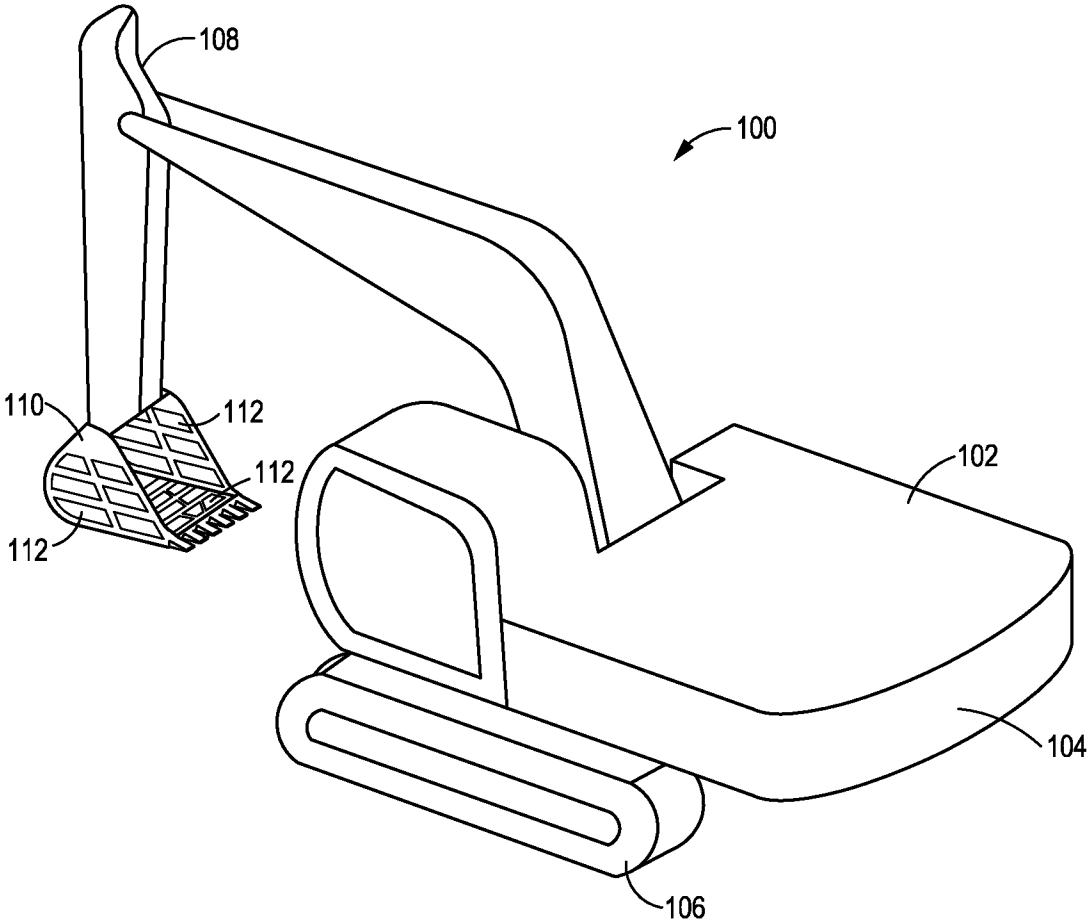
FIG. 1 is a perspective view of a work machine comprising a liner mounting assembly on a work implement of a working mechanism, in accordance with the present disclosure.

Referring now to the drawings, and with specific reference to FIG. 1, an exemplary work machine 100 is shown, illustrated as an excavator, and may be used, for example, for removing earth, soil, and other material from a landscape. Excavators are heavy equipment designed to move earth material from the ground or landscape at a dig site. Excavators are typically large and capable of excavating large volumes of earth at a single time by scraping or digging earth from beneath the ground or landscape surface. While the following detailed description describes an exemplary aspect in connection with the excavator, it should be appreciated that the description applies equally to the use of the present disclosure in other work machines as well, including but not limited to front-end loaders, backhoes, electric roper shovels, and the like.

The work machine 100 comprises a frame 102 containing an engine 104 supported on a ground engaging element 106 illustrated as continuous tracks. It should be contemplated that the ground engaging element 106 may be any other type of ground engaging element 106 such as, for example, wheels, etc. The work machine 100 further includes a working mechanism 108 for conducting work, such as, for example, excavating landscapes or otherwise moving earth, soil, or other material. The working mechanism 108 comprises a work implement 110 used to remove earth, soil, and other material from a landscape site. As illustrated in one embodiment, the working mechanism 108 may have a boom and an arm generally found on an excavator. The work implement 110 comprises a liner assembly 112. A plurality of the liner assembly 112 may be mounted on the walls of the work implement 110 for protecting the work implement 110 during operation of the work machine 100.

Figure 2:
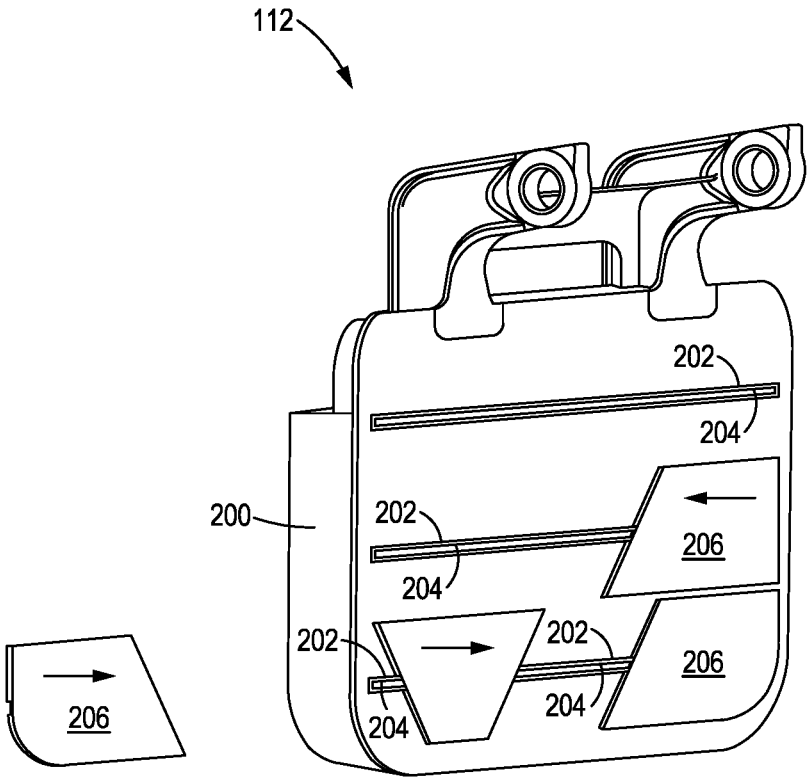
FIG. 2 is a schematic view of the liner assembly mounted on sidewall of a work implement, according to an embodiment.
Figure 3:
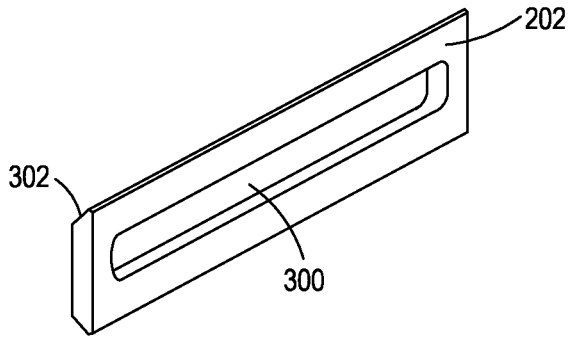
FIG. 3 is a perspective view of the wedge, according to an embodiment.
Figure 4:
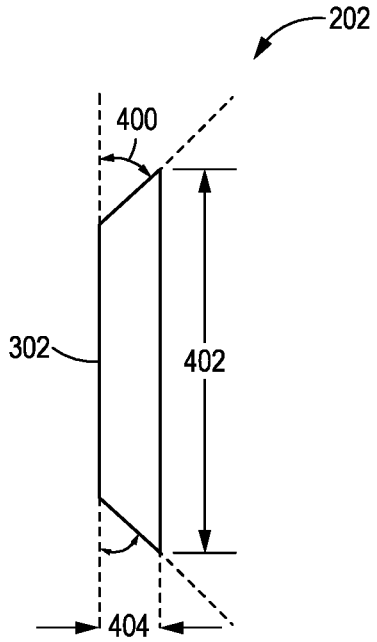
FIG. 4 is a side view of the wedge of FIG. 2, according to an embodiment.
Figure 5:
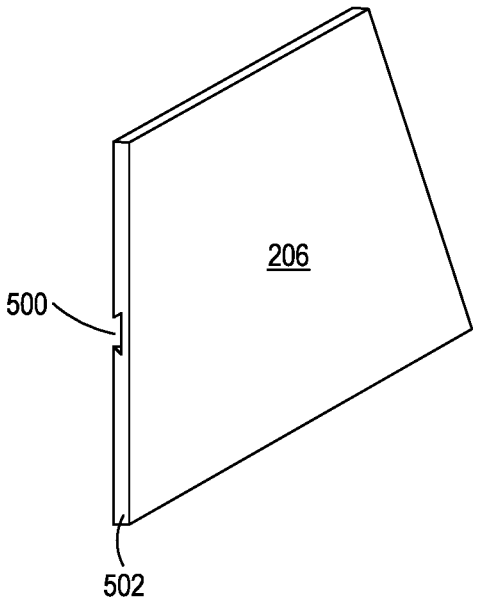
FIG. 5 is a perspective view of the front side of a liner plate of the liner assembly, according to an embodiment.
Figure 6:
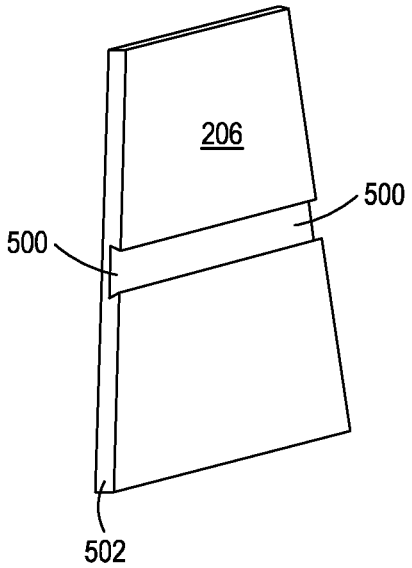
FIG. 6 is a perspective view of the back side of the liner plates of the liner assembly, according to an embodiment.

Referring now to FIG. 2, the liner assembly 112 is disclosed. Specifically, the liner assembly 112 for the work implement 110 of the work machine 100 is illustrated. The liner assembly 112 comprises a sidewall 200, a wedge 202, a weld 204, and a liner plate 206. The sidewall 200 can be understood to be a portion of a wall on the exterior and/or interior of a work implement 110 such as a bucket, dipper, or dig tool of the work machine 100 such as an excavator. As seen in FIG. 2, the liner plate 206 can slide onto the wedge 202 along the sidewall 200. Each the liner plate 206 may be shaped to fit next to another the liner plate 206 on the wedge 202.

Now referring to FIGS. 3-6, in one embodiment, the wedge 202 comprises a slot 300 where the weld 204 is inserted to mount the wedge 202 onto the sidewall 200. The weld 204 material may be made out of aluminum, steel, cast iron, metal, or other generally known weld material. The weld 204 may be replaced with an adhesive. The wedge 202 has a receiving channel 302 on its side to allow for the liner plate 206 to attach to the wedge 202. The receiving channel 302 may have a channel orientation 400, a wedge height 402, and a wedge width 404. The liner plate 206 have an engaging channel 500 on one of its sides so that it may interface with the receiving channel 302 and attach the liner plate 206 onto the wedge 202.

The engaging channel 500 defines the receiving channel 302 to form a wedge-plate interface. As illustrated, the receiving channel 302 has a channel orientation 400 with an angular profile, such angles capable of ranging from 5° to 85°. There may be other generally known interface or engagement profile types for allowing the liner plate 206 to attach to the wedge 202. For example, the channel orientation 400 may have a concave shape where the receiving channel 302 is rounded and the engaging channel 500 define the concavity of the receiving channel 302.

A plate side 502 of the liner plate 206 is generally thicker than the wedge width 404 and the engaging channel 500. For example, the plate side 502 may be twice as thick as the wedge width 404. The thickness of the wedge width 404 may be understood to be thick enough where a suitable amount of weld 204 filled in the slot 300 is able to secure the wedge 202 to the sidewall 200 and hold the liner plate 206 along the sidewall 200. It will be recognized that the wedge 202 may be sized differently to support a different sized liner plate 206 by scaling the receiving channel 302, the channel orientation 400, the wedge height 402, and the wedge width 404, accordingly to the environment of the work implement 110. For example, the wedge 202 may support the liner plate 206 made of metal and weigh 5000 lbs or more. The liner plate 206 may be made of metal, steel, iron, or other protective liner material suitable for work implement 110.

Figure 7:
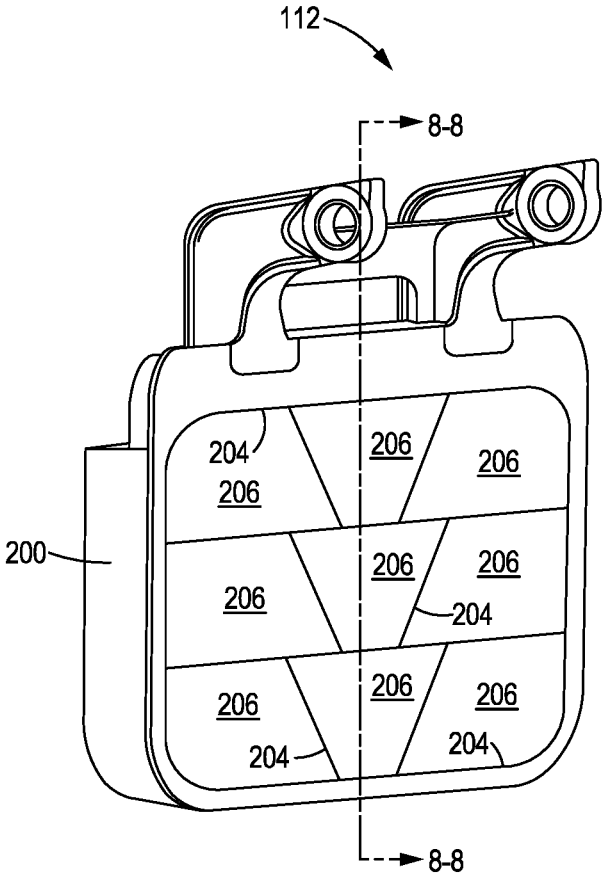
FIG. 7 is a perspective view of a liner assembly fully installed on a sidewall of a work implement, according to an embodiment.

Referring to FIG. 7, in an illustrated embodiment the liner assembly 112 is shown with the liner plate 206 installed to the sidewall 200. The weld 204 is further applied around the perimeters of each of the liner plate 206 connecting and securing different shaped the liner plate 206 together to cover the sidewall 200. When installed, the liner plate 206 covers and protects the sidewall 200 with no gaps between the plates. Any gaps may be filled with the weld 204. The weld 204 may be a general tack weld or general fillet weld type. The weld 204 may be made of steel, aluminum, stainless steel, or other metal. The weld 204 may be replaced by a different material such as an adhesive suitable for a work implement 110.

Figure 8:
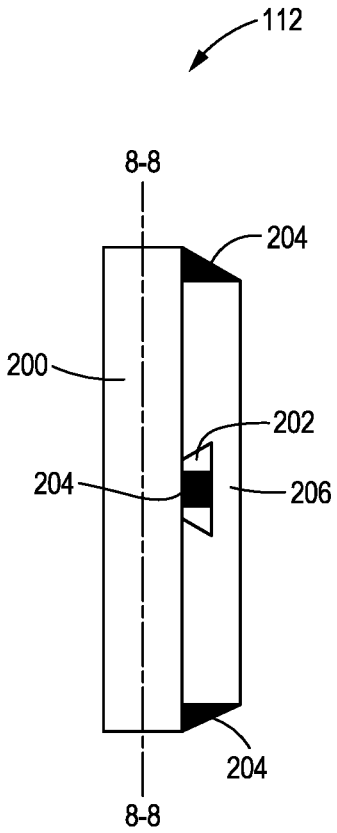
FIG. 8 is a cross-section of the liner assembly of FIG. 7 taken along line 8-8 of FIG. 7, according to an embodiment.

Now referring to FIGS. 7-8, in one embodiment, a cross section of the liner assembly 112 is shown along line 8-8 from FIG. 7. The liner plate 206 is mounted on the wedge 202 which is mounted on the sidewall 200. The wedge 202 is mounted on the sidewall 200 by placing the weld 204 into the slot 300 whereby securing the wedge 202 onto the sidewall 200. The liner plate 206 is then attached onto the wedge 202 and along the sidewall 200. The liner plate 206 is further secured to the sidewall 200 by adding additional weld 204 around the perimeter of the liner plate 206. The wedge 202 is encapsulated by the liner plate 206 formed to the sidewall 200 whereby the wedge 202 is not shown from the exterior of the liner assembly 112. The wedge 202 and the liner plate 206 may come in different shapes and sizes. The wedge 202 may have a plurality of liner plate 206 that can easily slide or attach onto the wedge 202. The liner plate 206 may be formed to the shape of the sidewall 200 with a flat or curvature formation.

Figure 9:
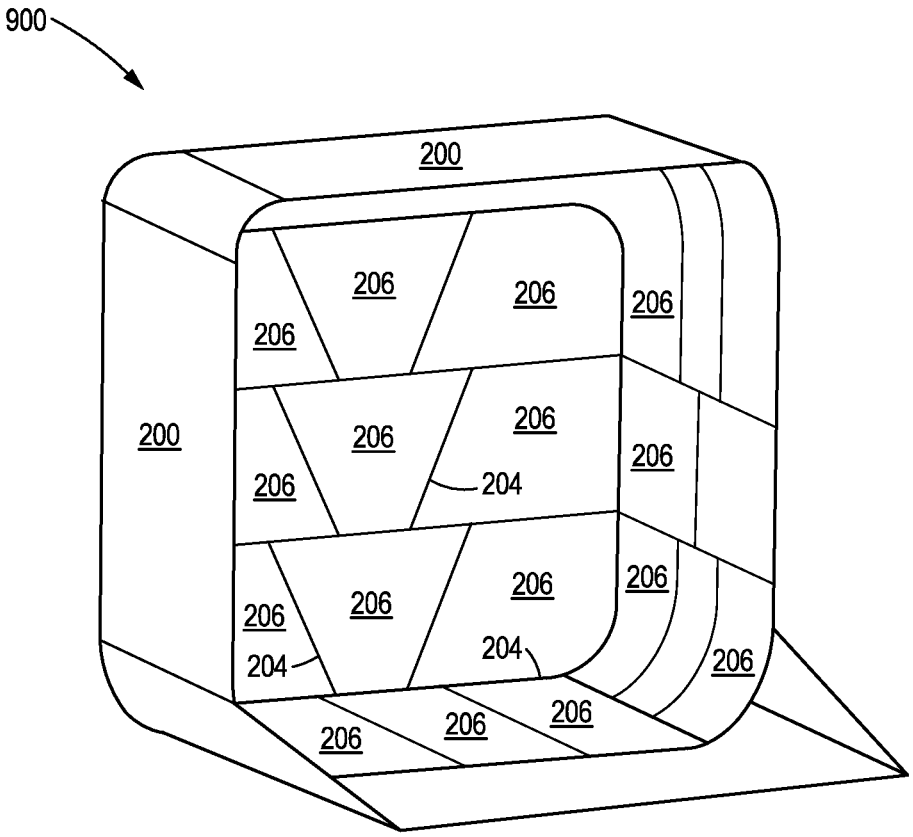
FIG. 9 is a perspective view of a dipper of a work machine comprising the liner assembly, according to an embodiment.

Now referring to FIG. 9, the work implement 110 may be a dipper 900 comprising the liner assembly 112. The liner plate 206 is placed throughout the interior of the dipper 900 and along the wedge 202, not shown in FIG. 9 but as depicted in FIG. 2. The liner plate 206 is further secured to the dipper 900 by welding the perimeters of the liner plate 206 with the weld 204. Any gaps between the liner plate 206 is filled with the weld 204. It is understood that the liner assembly 112 will wear down after significant use of the dipper 900 during operation of the work machine 100 comprising the dipper 900.

Figure 10:
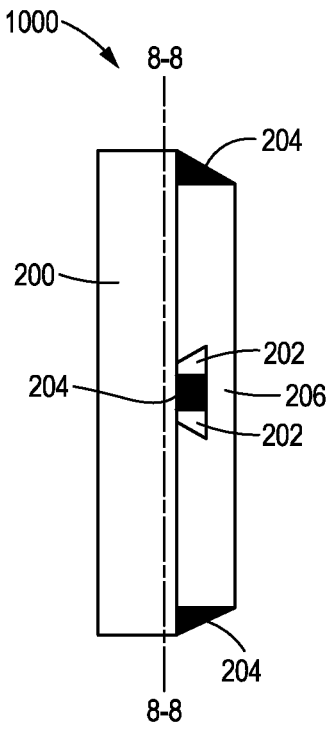
FIG. 10 is a cross-section of a new liner assembly taken along line 8-8 of FIG. 7 on a sidewall of a work implement before operation of a work machine, in accordance with an embodiment of the present disclosure.
Figure 11:
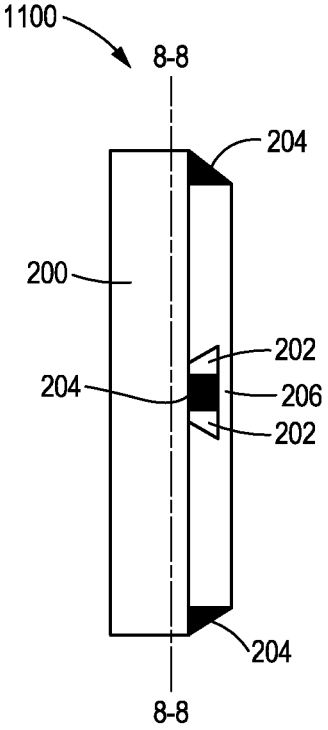
FIG. 11 is a cross-section of a used liner assembly taken along line 8-8 of FIG. 7 on a sidewall of a work implement during operation of a work machine, in accordance with an embodiment of the present disclosure.
Figure 12:
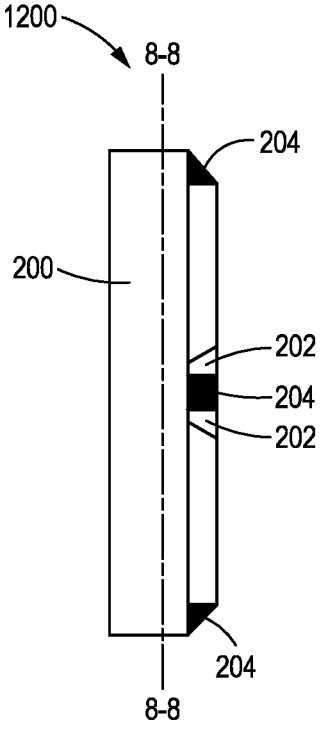
FIG. 12 is a cross-section of a worn liner assembly taken along line 8-8 of FIG. 7 on a sidewall of a work implement after operation of a work machine, in accordance with an embodiment of the present disclosure.

Now referring to FIG. 10-12, a new liner assembly 1000, a used liner assembly 1100, and a worn liner assembly 1200 is shown to demonstrate the usable life of the liner plate 206 on the dipper 900 during operation of a work machine. When the liner assembly 112 is installed on the dipper 900 as the new liner assembly 1000, the wedge 202 is not exposed. As the new liner assembly 1000 is worn down to the used liner assembly 1100, the liner plate 206 may begin to expose the wedge 202 and the weld 204 filled in the slot 300. As the used liner assembly 1100 is worn down further to the worn liner assembly 1200, the wedge 202 is worn down along with the liner plate 206. The receiving channel 302 and engaging channel 500 allows the liner plate 206 to remain attached to the sidewall 200 even when the wedge 202 is also worn down, as shown in the worn liner assembly 1200 in FIG. 12.

Figure 13:
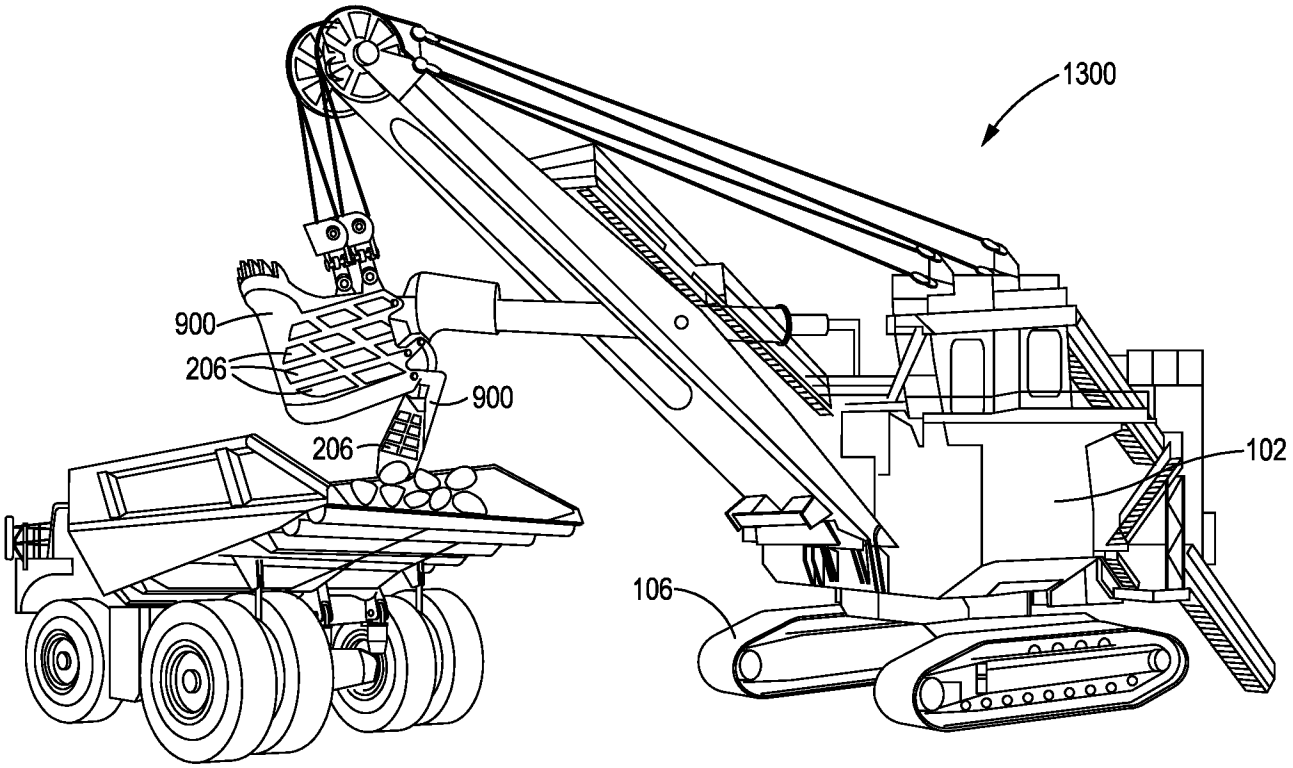
FIG. 13 is a perspective view of an electric rope shovel comprising a liner mounting assembly on a dipper of a working mechanism, in accordance an embodiment of the present disclosure.

Referring to FIG. 13, in another illustrated embodiment, the dipper 900 is illustrated as attached to an electric rope shovel 1300. Generally, an electric rope shovel is a bucket-equipped machine, usually electrically powered, used for digging and loading earth or fragmented rock and for mineral extraction. As illustrated, the dipper 900 comprises the liner assembly 112 with the liner plate 206 attached to the dipper 900. The dipper 900 in FIG. 13 is illustrated as an electric rope shovel bucket comprising the liner plate 206 on interior sidewall portions and exterior sidewall portions. As earth material is excavated by the dipper 900, the dipper 900 may have a wall that opens to dump the earth material into a dump vehicle, or specified location at a site. The liner plate 206 attached on the dipper 900 protects the dipper 900 as it shovels earth material, fragmented rock, or minerals, as well as protecting the dipper 900 when transferring or dumping the material to a dump vehicle or a specified location.

INDUSTRIAL APPLICABILITY

In operation, the present disclosure may find applicability in many industries including, but not limited to, the construction, earth-moving, and agricultural industries. Specifically, the technology of the present disclosure may be used in work machines of such industries including but not limited to excavators, backhoes, and front-end loaders and the like having a work implement 110 such as buckets, dippers, dig tools, and the like. While the foregoing detailed description is made with specific reference to work machine dippers, it is to be understood that its teachings may also be applied onto the door and the body of a bucket or dipper as well as protecting sidewalls of work machines, work implements, and the like.

One or more embodiments of the liner assembly 112 provide advantages of reducing installation time, reducing part counts, and extending the useful life of liner assemblies for work implements by preventing premature fall-out. Preventing premature fall-out provides an advantage of reducing unnecessary delays, unnecessary service time, and extends the usability of protection by the liner plate 206 which ultimately extending the usability of the work implement 110.

The wedge 202 mounted on the dipper 900 with the weld 204 in the slot 300 eliminates requiring central slot welds in conventional plates for welding to a sidewall 200. The conventional plates with central slot welds are prone to detaching prematurely from the dipper 900 during operation of a work machine. The present disclosure provides a method for allowing the liner plate 206 to be attached to the wedge 202 reducing the risk of falling out from the dipper 900 prematurely, even when the weld 204 is worn down, as shown in the worn liner assembly 1200.

Figure 14:
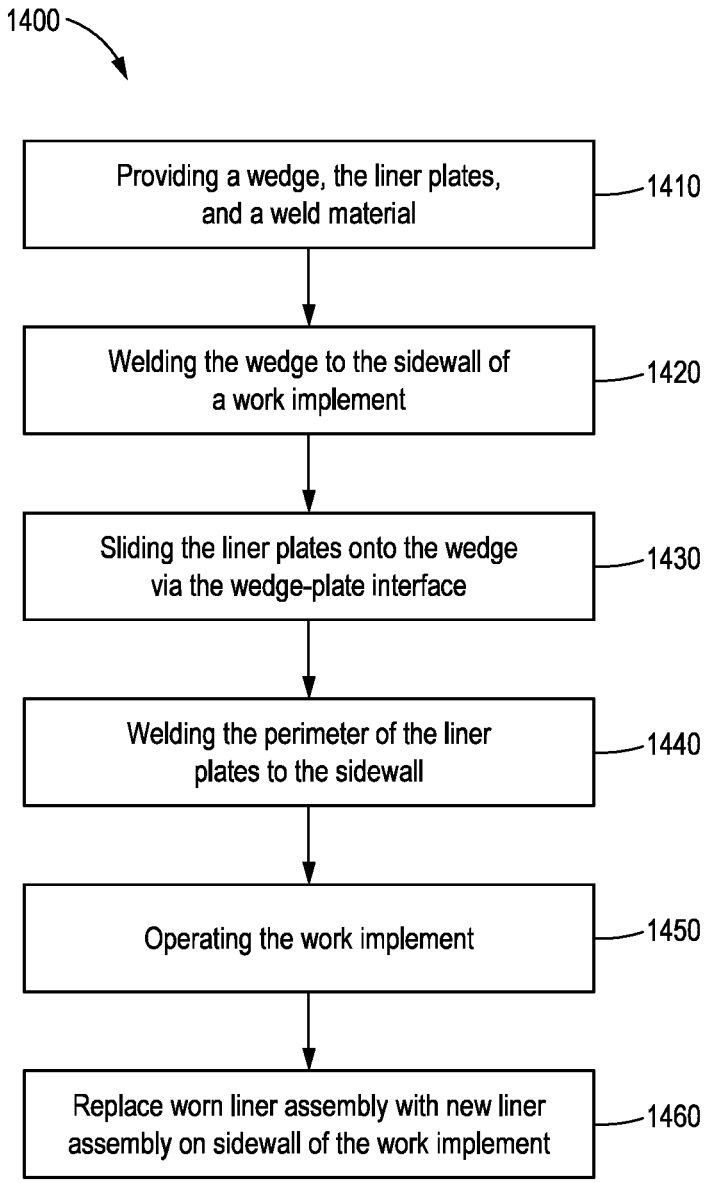
FIG. 14 is a flow chart depicting a sample sequence of steps that may be conducted in accordance with the method of using the liner assembly of the present disclosure.

Referring to FIG. 14, a method 1400 of using the liner assembly 112 is demonstrated according to one method of using the present disclosure. The method 1400 beings with providing the wedge 202, the liner plate 206, and the weld 204 for mounting on the sidewall 200, in a step 1410. In a step 1420, the wedge 202 is mounted on the sidewall 200 by welding the wedge 202 to the sidewall of the work implement 110 like the dipper 900 by filling the slot 300 with the weld 204. The weld 204 filled in the slot 300 secures the wedge 202 onto the sidewall 200.

In a step 1430, the liner plate 206 is then attached onto the wedge 202 by sliding the engaging channel 500 onto the receiving channel 302 of the wedge 202. The wedge 202 is encapsulated by the liner plate 206 formed to the sidewall 200 whereby the wedge 202 is not shown from the exterior of the liner assembly 112. The liner plate 206 may be formed to the shape of the sidewall 200 with a flat or curvature formation that can easily slide or attach onto the wedge 202.

In a step 1440, the liner plate 206 is further secured to the sidewall 200 by adding additional weld 204 around the perimeter of the liner plate 206. The gaps between the liner plate 206 may be filled with additional weld 204.

In a step 1450, the work implement 110 is then operated with the liner assembly 112 protecting the sidewall 200 of the work implement 110. For example, the dipper 900 would be protected by the liner assembly 112 during the operation of the work machine 100 when the working mechanism 108 is operating the dipper 900 against the ground, soil, or other earth material.

In a step 1460, when the new liner assembly 1000 is worn down to the worn liner assembly 1200, the worn liner assembly 1200 is quickly replaced with the new liner assembly 1000 by the method 1400 disclosed herein. After removing the worn liner assembly 1200, any unwanted weld 204 not removed from the sidewall 200 may be scraped off prior to installing the new liner assembly 1000.

The method 1400 of using the liner assembly 112, as disclosed herein, provides the work implement 110 of the work machine 100 a longer use life, longer-lasting protection, avoids premature fall-out, and provides quicker installation and service time.

From the foregoing, it can be seen that the technology disclosed herein has industrial applicability in a variety of settings such as, but not limited to, the plate lining of sides of work machines to extend the life of a wall while providing quick installation and service repair.

What is claimed is:

1. A liner assembly for a work implement of a work machine, comprising:

a wall of the work implement;

a wedge, the wedge includes:

a slot, and a receiving channel, the wedge being mounted to the wall of the work implement by filling the slot with a weld; and a liner plate supported by the wedge, the liner plate including:

an engaging channel complementary to the receiving channel of the wedge to form a wedge-plate interface connecting the liner plate to the wedge and onto the wall of the work implement, wherein a length of the liner plate is less than a length of the wedge, and wherein a width of the liner plate perpendicular to the length thereof is greater than a width of the wedge perpendicular to the length thereof.

2. The liner assembly according to claim 1, wherein the weld is further applied along a perimeter of the liner plate.

3. The liner assembly according to claim 2, wherein the weld is made of one of aluminum, steel, cast iron, metal, and adhesive.

4. The liner assembly according to claim 2, wherein the work implement is one of a bucket, dipper, and dig tool of the work machine.

5. The liner assembly according to claim 2, wherein the wedge-plate interface has one of an angular and concave interface.

6. A work machine comprising:

a frame;

a ground engaging element supporting the frame for movement;

an engine mounted on the frame;

a boom extending from the frame;

a work implement associated with the boom, the work implement including a sidewall and a liner assembly, wherein the liner assembly includes:

a wedge, the wedge of the liner assembly includes:

a slot, and a receiving channel, the wedge of the liner assembly being mounted to the sidewall of the work implement by filling the slot of the wedge with a weld; and a liner plate along the sidewall of the work implement supported by the wedge of the liner assembly, and wherein the liner plate of the liner assembly includes an engaging channel complementary to the receiving channel of the wedge to form a wedge-plate interface connecting the liner plate to the wedge of the liner assembly and onto the sidewall of the work implement, and wherein the liner assembly has a plurality of the liner plates per wedge.

7. The work machine according to claim 6, wherein the weld is provided along a perimeter of the liner plate securing the liner plate to the work implement.

8. The work machine according to claim 6, wherein the work implement is one of a bucket, dipper, and dig tool of the work machine, and the work machine is one of an excavator, a front-end loader, an electric rope shovel, and a backhoe.

9. The work machine according to claim 6, wherein the weld is made of one of aluminum, steel, cast iron, metal, and adhesive.

10. The work machine according to claim 6, wherein the wedge and the liner plate is made of one of metal, steel, iron, and aluminum.

11. The work machine according to claim 6, wherein the liner plate is one of curvature and flat.

12. The work machine according to claim 6, wherein the liner plate is formed to a shape of the work implement.

13. The work machine according to claim 6, wherein the wedge-plate interface has one of an angular and concave interface.

14. A method of protecting a sidewall of a work implement of a work machine using a liner assembly, the method comprising:

providing a wedge, a liner plate, and a weld, wherein the wedge includes a slot and a receiving channel and the liner plate includes an engaging channel complementary to the receiving channel to form a wedge-plate interface for attaching the liner plate on the wedge and along the sidewall;

welding the wedge to the sidewall by filling the weld into the slot;

securing the liner plate on the wedge and along the sidewall by inserting the engaging channel onto the receiving channel;

providing another said wedge, another said liner plate, and another said weld forming another wedge-plate interface for attaching said another liner plate on said another wedge and along the sidewall; and securing said another liner plate on said another wedge and along the sidewall such that an edge of the liner plate is adjacent to and touching an edge of said another liner plate.

15. The method according to claim 14, further comprising:

welding a perimeter of the liner plate with the weld to secure the liner plate with the weld to the sidewall.

16. The method according to claim 14, further comprising:

welding gaps between a plurality of said liner plates including said liner plate and said another liner plate with the weld to secure the plurality of liner plates with the weld to the sidewall.

17. The method according to claim 14, further comprising:

using the work implement during operation of the work machine until the liner assembly is worn away; and replacing the liner assembly with a new liner assembly comprising a new wedge, a new weld, and a new liner plate.

18. The method according to claim 16, wherein the work implement is one of a bucket, dipper, and dig tool of the work machine comprising a plurality of the liner assembly.

19. The method according to claim 17, wherein the wedge and the liner plate are made of one of metal, steel, iron, and aluminum; and the weld is made of one of aluminum, steel, cast iron, metal, and adhesive.

20. The method according to claim 17, wherein the liner plate is complementary to a shape of the work implement.

* * * * *